US005331384A

United States Patent [19]

Otsuka

[11] Patent Number: 5,331,384

[45] Date of Patent: Jul. 19, 1994

[54] FIXING APPARATUS HAVING TEMPERATURE CONTROLLER WHICH CONTROLS TEMPERATURE ACCORDING TO WIDTH SIZE AND NUMBER OF RECORDING SHEETS

[75] Inventor: Yasumasa Otsuka, Yokohama, Japan

[73] Assignee: Canon Kabushiki Kaisha, Tokyo, Japan

[21] Appl. No.: 912,654

[22] Filed: Jul. 9, 1992

Related U.S. Application Data

[63] Continuation of Ser. No. 469,945, Jan. 25, 1990, abandoned.

[30] Foreign Application Priority Data

Jan. 25, 1989 [JP] Japan ..... 1-14058
Apr. 12, 1989 [JP] Japan ..... 1-90811

[51] Int. Cl.[5] ..... G03G 15/20

[52] U.S. Cl. ..... 355/290; 219/216; 355/285

[58] Field of Search ..... 355/282, 285, 289, 290, 355/208, 308, 309, 311; 219/216

[56] References Cited

U.S. PATENT DOCUMENTS

| | | | |
|---|---|---|---|
| 3,832,524 | 8/1974 | Takiguchi | 219/216 |
| 4,348,102 | 9/1982 | Sessink | 355/208 X |
| 4,434,353 | 2/1984 | Marsh et al. | 219/216 |
| 4,719,489 | 1/1988 | Ohkubo et al. | 355/285 |
| 4,801,968 | 1/1989 | Kogure et al. | 219/216 X |
| 4,825,242 | 4/1989 | Elter | 355/208 |
| 4,933,724 | 6/1990 | Sugimoto et al. | 355/285 X |

FOREIGN PATENT DOCUMENTS

| | | |
|---|---|---|
| 57-063570 | 4/1982 | Japan . |
| 0073773 | 5/1982 | Japan . |
| 0087574 | 5/1983 | Japan . |
| 0095770 | 6/1983 | Japan . |
| 58-095770 | 6/1983 | Japan . |
| 0211176 | 12/1983 | Japan . |
| 59-045475 | 3/1984 | Japan . |
| 59-147168 | 10/1984 | Japan . |
| 60-247277 | 12/1985 | Japan . |
| 0186976 | 8/1986 | Japan . |

*Primary Examiner*—A. T. Grimley
*Assistant Examiner*—Robert Beatty
*Attorney, Agent, or Firm*—Fitzpatrick, Cella, Harper & Scinto

[57] ABSTRACT

In an image forming apparatus including a fixing device for heating and fixing a toner image on a recording material, a temperature detector for detecting the temperature of the surface of a fixing roller is provided substantially outside a passing region of the recording material on the fixing roller. The temperature at a central portion of the surface of the fixing roller is always maintained at a fixing temperature which is most suitable, irrespective of the width size of the recording material to be fixed. Furthermore, when sheets of recording material are continuously fed and fixed, the temperature at an end portion of the fixing roller, provided with the temperature detector is changed in accordance with the number of sheets to maintain the central portion of the fixing roller always at a temperature which is most suitable. Thus, it is possible always to perform image formation having an excellent quality.

24 Claims, 12 Drawing Sheets

FIXING APPARATUS HAVING TEMPERATURE CONTROLLER WHICH CONTROLS TEMPERATURE ACCORDING TO WIDTH SIZE AND NUMBER OF RECORDING SHEETS

This application is a continuation of application Ser. No. 07/469,945 filed Jan. 25, 1990, now abandoned.

BACKGROUND OF THE INVENTION

1. Field of the Invention

This invention relates to an image forming apparatus including a fixing device for fixing, by heating, a toner image on a recording material.

2. Description of the Related Art

Heretofore, temperature detection means in a fixing device has been situated at a central portion in the longitudinal direction of the surface of a fixing roller heated by a heating source. In this case, toner may adhere on the surface of the temperature detection means or a flaw may be produced in the roller when the temperature detection means contacts the roller, and black stripes may therefore be produced in an image. In order to solve these problems, there has been known a device in which temperature detection means is disposed at an end portion of a fixing roller (Japanese Utility Model Public Disclosure (Chalk) No. 59-147168 (1984)).

However, even if temperature detection means is disposed at an end portion of a heating (fixing) roller to detect the temperature at the end portion, exact temperature control of a fixing roller cannot be performed without taking into consideration the temperature of a central portion of the roller where a recording material passes, causing failure in fixing.

More specifically, images are typically formed using three kinds of recording materials A, B and C ($A>B>C$ in width) having different widths (the length in the axial direction of the fixing roller). As shown in FIG. 5, if temperature control means is controlled so as to maintain a temperature which is most suitable at a position where a temperature detector is disposed, the surface temperature at a central portion of the fixing roller has variations. It is therefore impossible to maintain a temperature which is most suitable for fixing. This is because the temperature at the central portion decreases to cause failure in fixing in the case of the recording material C having the smallest size, and the temperature at the central portion becomes too high so as to produce high-temperature offset in the case of the recording material A having the largest size when a temperature has previously been set in accordance with the recording material C.

SUMMARY OF THE INVENTION

It is an object of the present invention to provide an image forming apparatus including fixing means which can always maintain the temperature at a central portion of the surface of a rotating body for fixing at a proper temperature.

It is another object of the present invention to provide an image forming apparatus including fixing means which can prevent adhesion of toner or powder of paper to temperature detection means.

It is still another object of the present invention to provide an image forming apparatus including fixing means which can prevent failure in fixing due to differences in the size of recording materials or continuous feeding of recording materials.

In one aspect of the invention, an image forming apparatus comprises means for forming an unfixed toner image on a recording material, fixing means, including a pair of rotating members at least one of which is heated by a heating source, for fixing the unfixed toner image on the recording material by conveying the recording material past a passing region of the pair of rotating members, temperature detecting means for detecting a surface temperature of said rotating member, said detection means being provided substantially outside the passing region, and control means for controlling the heating source so as to adjust the surface temperature detected by the temperature detection means to a predetermined temperature, the control means changing the predetermined temperature in accordance with information concerning the recording material.

These and other objects and features of the present invention will become more apparent from the following detailed description made in reference to the accompanying drawings.

DETAILED DESCRIPTION OF THE PREFERRED EMBODIMENTS

As an example of the image forming apparatus of the present invention, an electrophotographic apparatus will be explained.

Image formation in the electrophotographic apparatus is performed, for example, by the following process.

Figure 1:
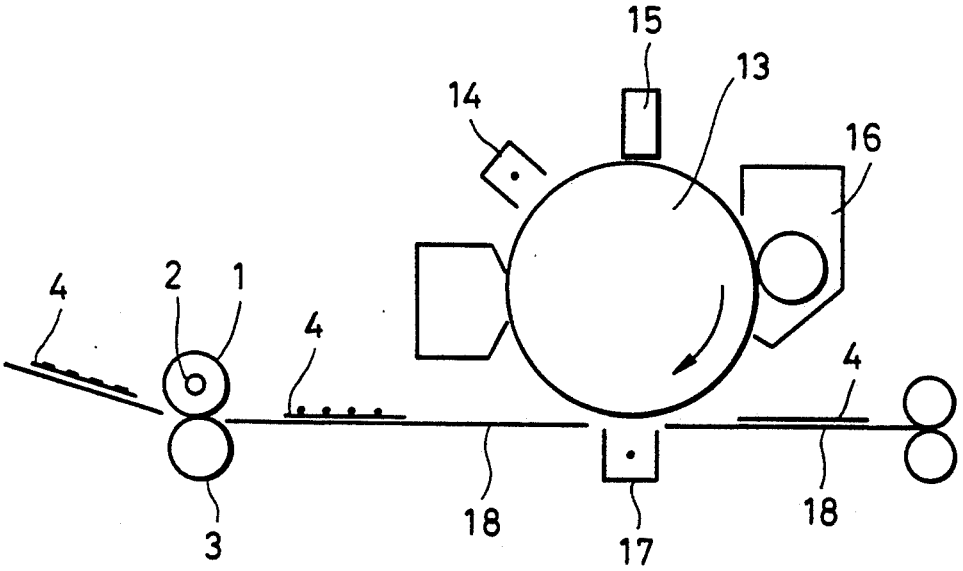
FIG. 1 a schematic diagram of an image forming apparatus.

In FIG. 1, a photosensitive drum 13 as an image carrying member is uniformly charged by a charger 14. An electrostatic latent image is formed on the drum by exposing it to image information by an exposure means 15. Subsequently, toner is supplied from a developer 16, and the latent image on the photosensitive drum 13 thereby becomes a visible image (a toner image). The toner image is transferred to a recording material 4 conveyed via a conveying channel 18 by a transfer unit 17, and an unfixed toner image is formed on the recording material 4.

The unfixed toner image on the recording material formed in the process as described above is fixed by a fixing device, and a desired image can thus be obtained.

An example of the fixing device to which the present invention can be applied will now be explained with reference to FIGS. 2 and 3.

Figure 2:
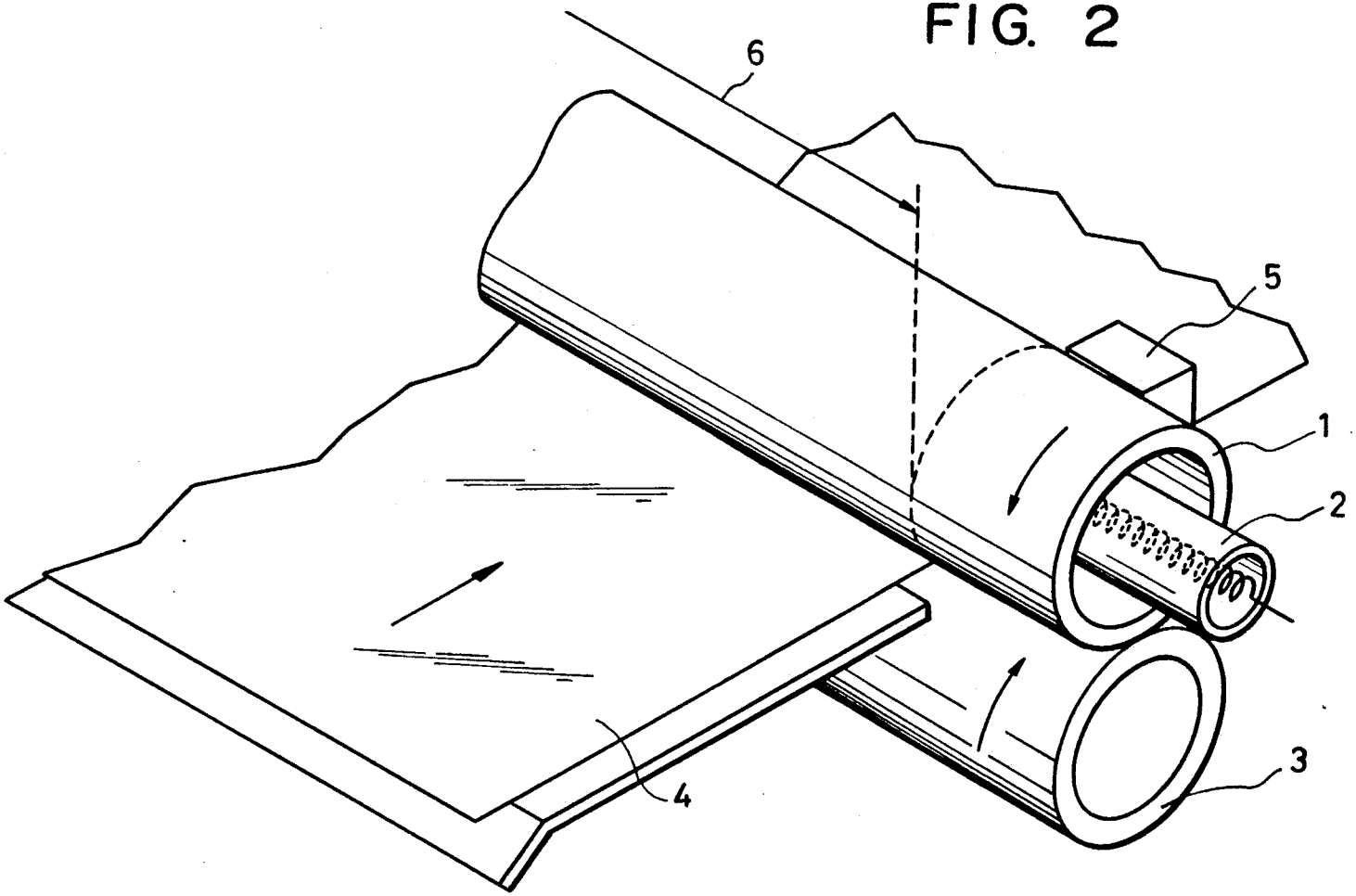
FIG. 2 is a perspective view around a fixing roller where temperature detection means is situated outside a passing region of recording paper.
Figure 3:
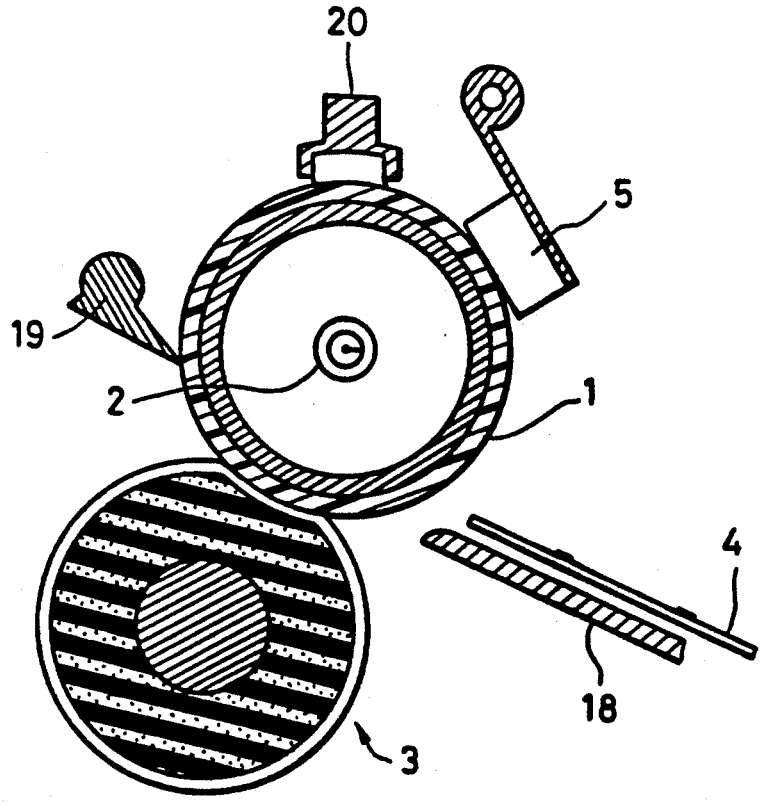
FIG. 3 is a cross-sectional view around a fixing roller.

In FIGS. 2 and 3, there are shown a fixing roller 1, a heater 2 as a heating source provided within the fixing roller 1, and a pressure roller 3. The fixing roller 1 and the pressure roller 3 are pressed against each other with a predetermined pressure by energizing means (not illustrated), and constitute a pair of rotating members. At a region outside a region 6 contacting the recording material 4 on the external circumference of the fixing roller 1, there is disposed a temperature detector 5 so as to contact the fixing roller 1. Size detection means for detecting the size (width) of the recording material 4 (not illustrated in FIGS. 2 and 3) is provided within the main body of the image forming apparatus. There are also shown a pawl 19 for separating the recording material 4 from the fixing roller 1, and a cleaner 20 for the fixing roller 1.

First, an explanation will be provided of a case (a first embodiment) in which temperature detection means is disposed outside a passing region of the recording material on the heated rotating body (the fixing roller in the present embodiment) and the temperature at a central portion of the rotating body is maintained at a proper value even if the width of the recording material differs.

Figure 6:
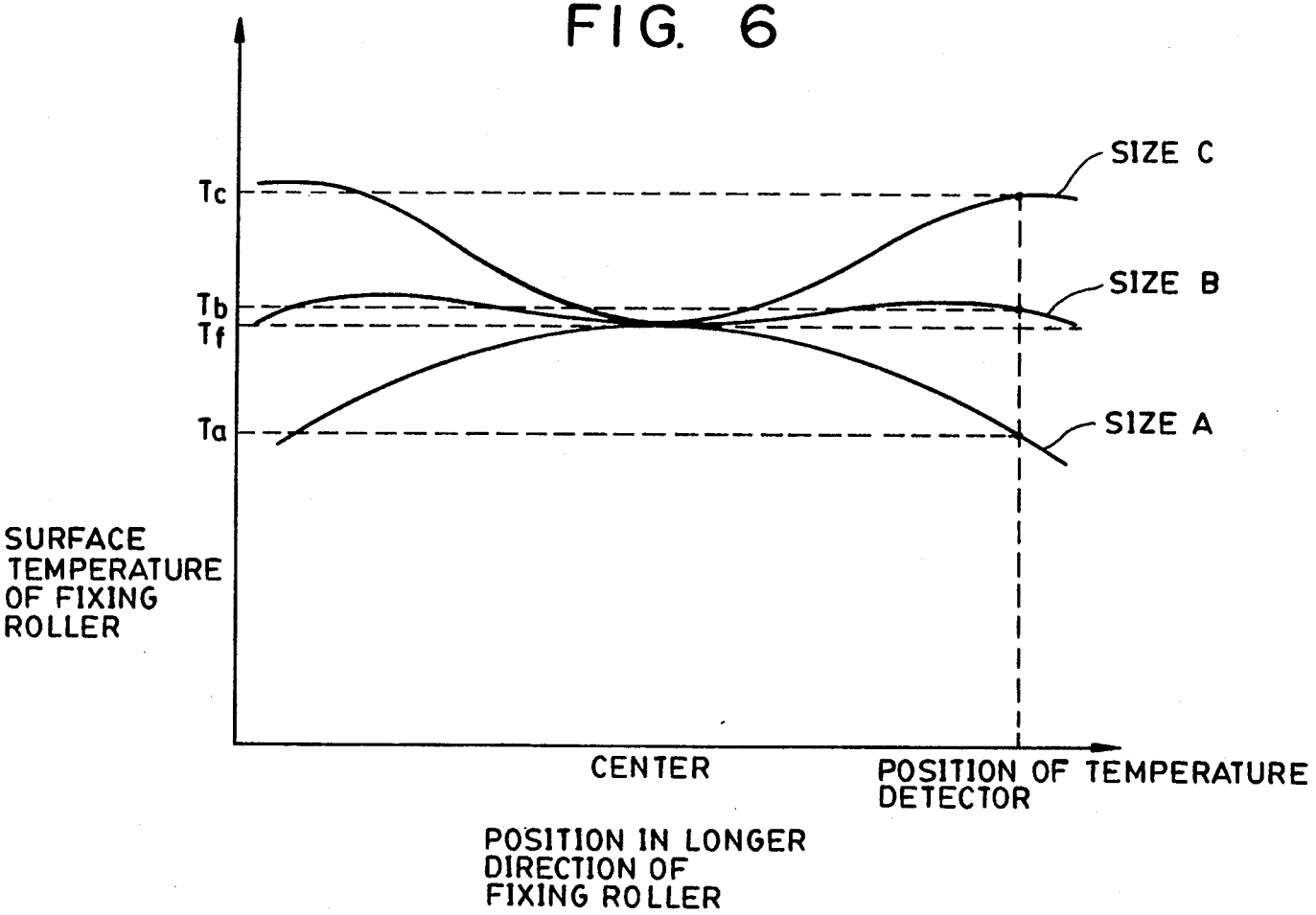
FIG. 6 is a diagram showing the distribution of the surface temperature of a fixing roller in a first embodiment.

When paper was fed through a more or less central portion in the longitudinal direction of the fixing roller 1, temperature control was performed so as to maintain a temperature Tf which is necessary for fixing a toner image at the central portion of the fixing roller 1, and the distribution of the surface temperature of the fixing roller 1 at that moment was investigated. The results are shown in FIG. 6. As shown in FIG. 6, it was confirmed that, when the surface temperature of the central portion is maintained at the temperature Tf necessary for fixing, the temperature near an end portion of the fixing roller 1 where the temperature detector 5 is disposed has different values according to the widths of the recording materials. That is, in the case of a recording material A having the largest size, the temperature near detector 5 should be Ta which is lower than Tf. In the case of a recording material B having a medium size, the temperature near detector 5 should be Tb which is nearly equal to Tf. Finally, in the case of a recording material C having the smallest size, the temperature near detector 5 should be Tc which is higher than Tf.

Thus, if the kind of recording material to be used and the state of the distribution of the surface temperature of the fixing roller 1 corresponding to the recording material is known, it is possible to maintain the temperature Tf necessary for fixing near the center of the fixing roller 1 by adjusting the temperature near the position where the temperature detector is disposed to a target value that is selected in accordance with each recording material.

Based on the fact as described above, the following experiments were performed using the apparatus shown in FIG. 2.

As the fixing roller 1, a roller made of an aluminum pipe having a thickness of 3.5 mm and an outer diameter of 30 mm coated with a PFA resin 25 μm thick was used. A 750-W (watts) halogen heater was disposed within the fixing roller 1 to perform heating. As the pressure roller 3, a roller made of a stainless cored bar having a diameter of 16 mm coated with a silicone-rubber sponge (Asker-c hardness 30°) 7 mm thick was used. The fixing roller 1 and the pressure roller 3 were pressed with a total pressure of 11.0 kgf. The nip width at that time became 3.5 mm. The halogen heater was set so that the amount of light emission at positions apart from the center by 90 mm toward two ends is 1.6 times the amount of light emission at a central portion in order to supplement the flow of heat from the two ends of the roller. As for recording materials, the B4-, A4- and B5-formats were used for the recording material A having the largest size, the recording material B having a medium size and the recording material C having the smallest size, respectively. The surface temperature Tf at the central portion of the fixing roller 1 was maintained at 180° C. The surface temperatures near the position where the temperature detector 5 was disposed when respective recording materials were used, that is, Ta, Tb and Tc in FIG. 6, were set to 170° C., 182° C. and 195° C. for the recording materials A, B and C, respectively.

When each recording material was fed through the center of the fixing roller 1 under the above-described conditions, since the surface temperature near the position where the temperature detector 5 was disposed was controlled in accordance with the size of each recording material, it was confirmed that the surface temperature Tf at the central portion of the fixing roller 1 can be maintained at near 180° C. irrespective of recording materials, and neither failure in fixing nor high-temperature offset occurs. Even when using the B4-format, which is the largest usable size in the present apparatus, since the temperature detector 5 was situated outside the region where the recording material contacted the fixing roller 1, it was also confirmed that, even if printing operation is performed two hundred thousand times or more, the fixing roller 1 is not damaged, and black stripes are not produced in printed images.

Figure 4:
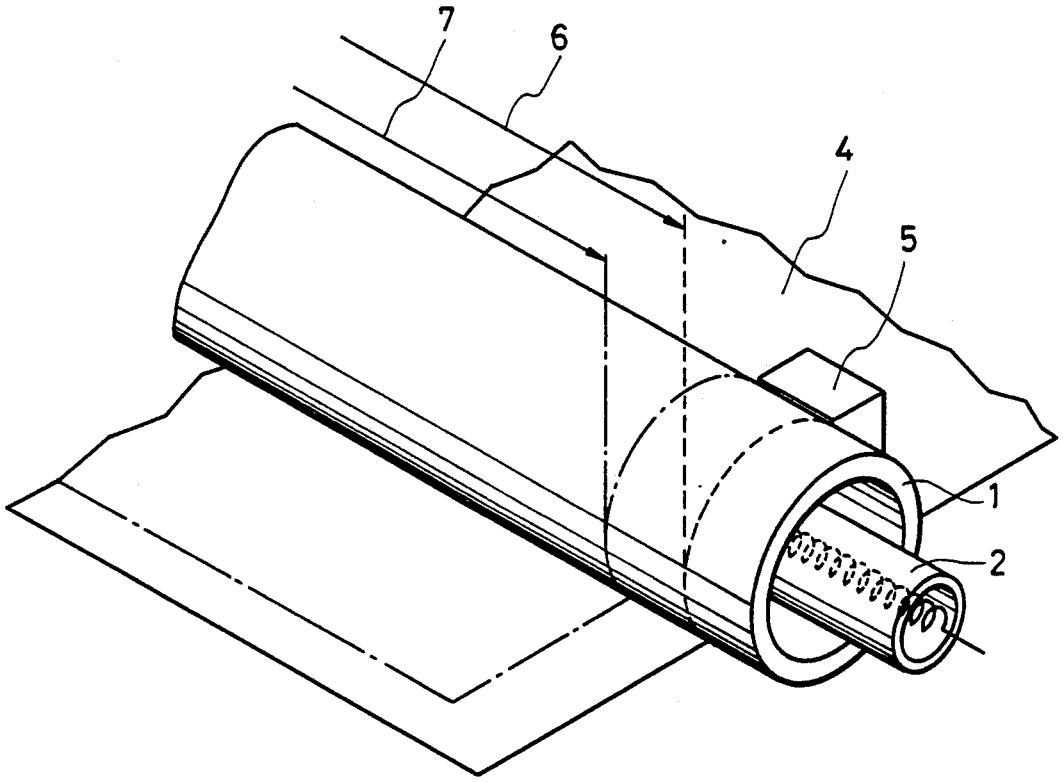
FIG. 4 is a perspective view of a fixing roller when temperature detection means is situated substantially outside a passing region of a recording material.
Figure 5:
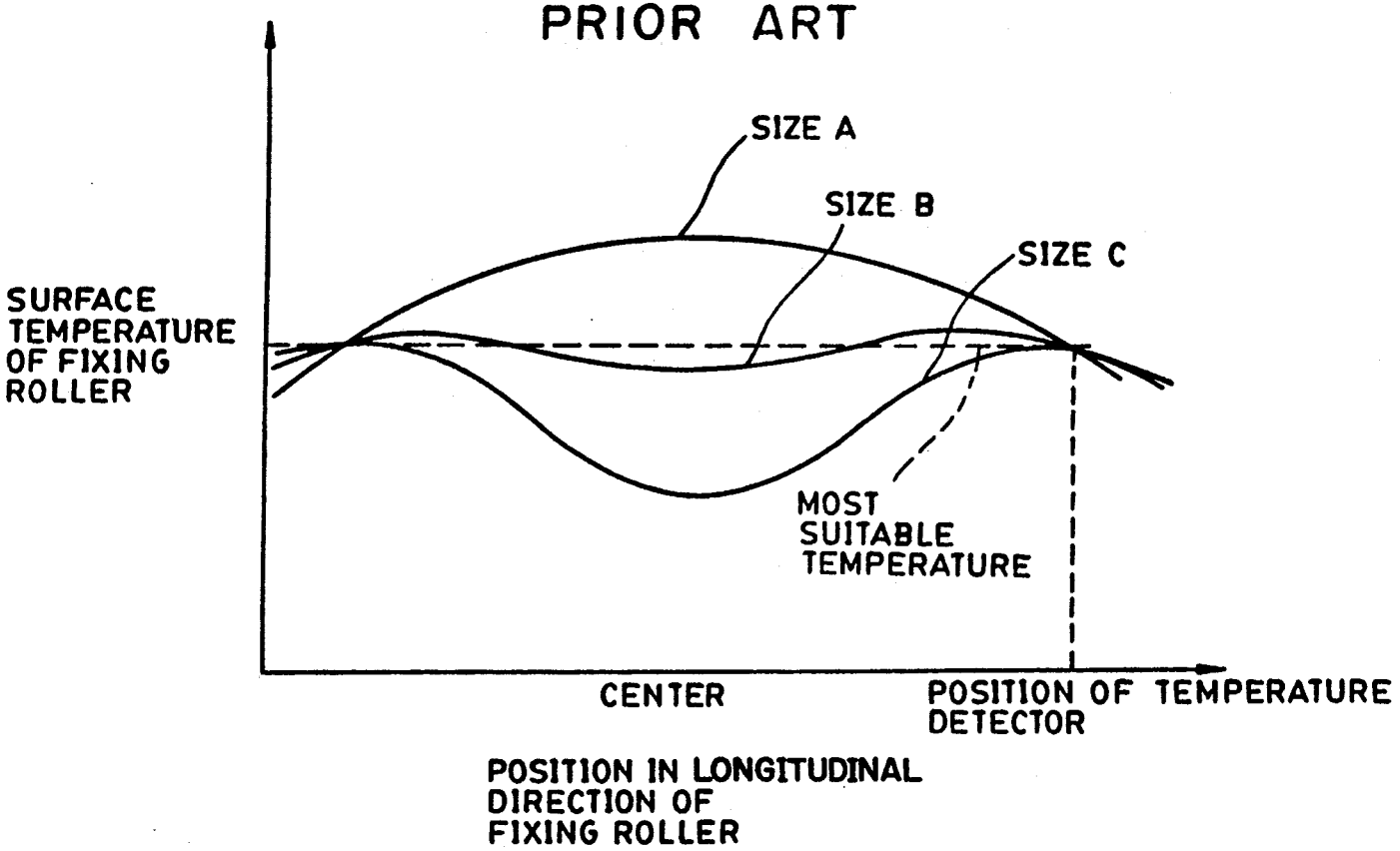
FIG. 5 PRIOR ART
FIG. 5 is a diagram indicating a conventional temperature control when temperature detection means is provided at an end of a fixing roller.

Next, a second embodiment (shown in FIG. 4) of the present invention will be explained. In FIG. 4, components identical to those in FIG. 2 are indicated by like numerals, and an explanation thereof will be omitted.

As shown in FIG. 4, when a recording material having the largest size is used, the temperature detector 5 may be disposed so as to be outside the width 7 of the region for a developer image such as a toner image indicated by a chain line in FIG. 4, though within the region where an end portion of the recording material contacts the fixing roller 1. That is, a part of temperature detection means may be situated at the passing region of the recording material having the largest size used in the image forming apparatus. It is to be noted that, in defining the present invention a configuration such as that shown in FIG. 4 is included in the provision of temperature detection means substantially outside a passing region of the recording material.

In the apparatus of the second embodiment as described above, since the temperature is detected at a position closer to the center of the fixing roller 1, it is possible to perform temperature control with higher accuracy. Furthermore, since the temperature detector 5 is disposed outside the width 7 of the region for developer images, toner and the like do not adhere to the detector, and hence the fixing roller 1 is not damaged. In addition, the fixing roller need not be longer merely to accommodate placement of the temperature detector. Thus, the length of the fixing roller 1 can be smaller than in the case of the first embodiment and, it is possible to provide a small-sized apparatus.

Next, an explanation will be provided of cases (third through sixth embodiments) in which temperature detection means is disposed outside the passing region of a recording material on the rotating body and the temperature at a central portion of the rotating body can always be maintained at a proper value even when sheets of the recording material are continuously fed (image forming operation is continuously performed for a plurality of sheets).

Figure 7:
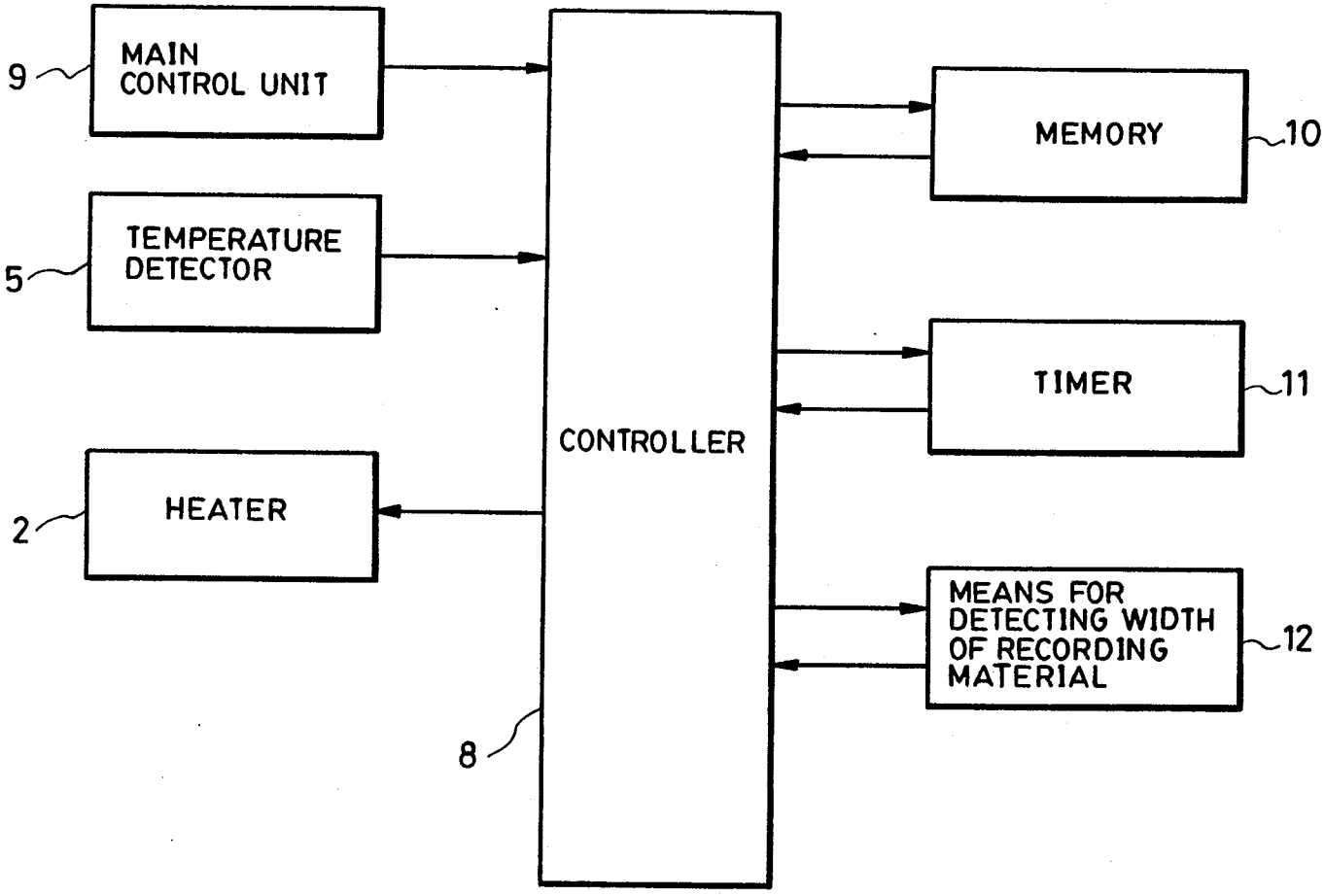
FIG. 7 is a schematic diagram showing a control unit of the present apparatus.

First, the third embodiment will be explained. In FIG. 7, the temperature detector 5 is connected to a controller 8. The controller 8 is also connected to the heater 2, and performs temperature control of the fixing roller 1 according to data input from the temperature detector 5. The controller 8 is further connected to a main control unit 9, and performs accumulated counting of the number of sheets of the recording material 4 by storing feed signals for the recording material 4 transmitted from the main control unit 9 in a memory 10.

Figure 8:
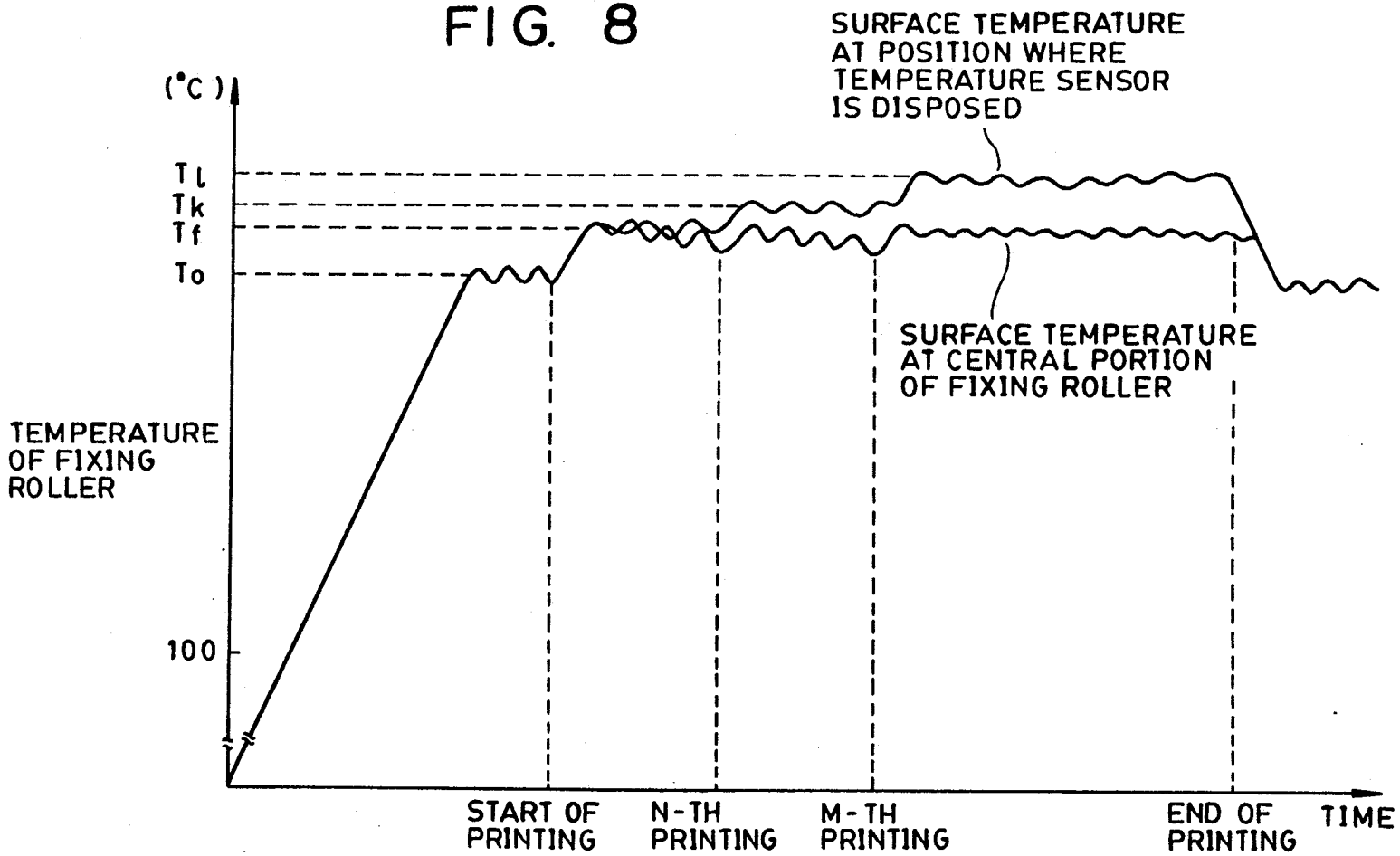
FIG. 8 is a diagram showing changes in the setting temperature of the surface of a fixing roller when sheets of a recording material are continuously fed and fixed.

In the apparatus as described above, a control method of the setting temperature for the surface of the rotating body in continuous feeding of sheets of the recording material will be explained with reference to FIG. 8.

First, the surface temperature at a central portion as a fixing portion on the fixing roller 1 which has been controlled at a waiting temperature To °C. is adjusted so as to become a temperature Tf °C. necessary for fixing by controlling the heater 2 by the controller 8 which has received a signal for the start of printing from the main control unit 9. The first target temperature Tf °C. has previously been stored in the memory 10. Temperature adjustment is performed with this target temperature until the number of sheets of the recording material 4 becomes N. While the temperature control is being performed, the controller 8 is performing accumulated counting of the number of sheets of the recording material 4 by receiving signals from the main control unit 9. When the number of sheets of the recording material 4 becomes N, a second target temperature Tk °C. which is higher than Tf °C. described above is selected, and temperature adjustment is performed with Tk °C. until the number becomes M.

Since the surface temperature at the central portion of the fixing roller 1 gradually decreases as the number of sheets of the recording material 4 increases, the second target temperature Tk °C. represents a temperature for compensating the decreased temperature and a temperature difference between the position where the temperature detector 5 is disposed and the central portion of the fixing roller 1. Accordingly, even when temperature adjustment is performed with the target temperature Tk °C., the surface temperature at the central portion of the fixing roller 1 is maintained at Tf °C.

When the number of sheets of the recording material 4 becomes M, a third target temperature Tl °C. which is higher than Tk °C. described above is selected, and temperature adjustment is performed. The number M is set as a number sufficient enough so that there is no decrease in temperature in accordance with increase in the number of sheets of the recording material 4 and the temperature difference between the central portion of the fixing roller 1 and the position where the temperature detector is disposed becomes constant. Accordingly, temperature adjustment is performed at this Tl °C. until the end of printing. As a result of gradually increasing temperature in three stages Tf °C., Tk °C. and Tl °C. as described above, it is possible to maintain the surface temperature at the center of the fixing roller 1 at Tf °C. without producing offset, and therefore to obtain an excellent fixing property. Although three-staged target temperatures are used in the present embodiment, the number of stages may be increased to a larger value, and the number of sheets of the recording material for selecting target temperatures may be properly determined according to the thickness of the recording material to be used.

Next, experimental examples according to the third embodiment will be explained. As the experimental examples, the following two kinds of Examples (1) and (2) were performed using two kinds of fixing rollers. The fixing roller used in Example (2) comprises the fixing roller used in Example (1) provided with a layer made of an elastic rubber.

In Example (1), as the fixing roller 1, a roller made of an aluminum pipe material having an axial length of 233 mm, an outer diameter of 30 mm and a thickness of 3.5 mm coated with a PFA resin 25 μm thick was used. As the pressure roller 3, a roller made of a stainless cored bar having an outer diameter of 20 mm having a sponge layer 4 mm thick on its surface and also a solid rubber layer 1 mm thick on the surface layer the hardness of which is set to 30 degrees measured by an Asker-c hardness tester was used. As the heater 2, a 750-W halogen lamp was used. Sheets of a recording material having a letter size and a weight of 75 g were continuously fed through. The target temperature at the moment of initial printing was set to 190° C. Control was performed with a target temperature of 192° C. from the 20th to 39th sheets, and with a target temperature of 195° C. after the 40th sheets. As a result, the temperature at the central portion of the fixing roller 1 was maintained at about 190° C., fixing property was excellent, and no offset occurred.

Example (2) is particularly adapted to the situation where a rubber layer or the like having a poor heat conductive property is provided on the surface of the fixing roller 1 to improve fixing property and quality of printing or to reduce curling. However, such a roller is particularly apt to be damaged, and temperature differences in the axial direction are large compared with a case in which only a PFA resin is used, due to an inferior heat conductive property in the axial direction. According to the application of the present invention, the temperature at the central portion did not decrease even during continuous printing operations, an excellent fixing property could be obtained, and the problem of being damaged also disappeared. An experimental example will now be shown in the following description.

In Example (2), the fixing roller 1, a roller made of an aluminum pipe having the same size and material as in Example (1) coated with a layer of a silicone rubber 0.5 mm thick and a layer of a PFA resin 30 μm thick on the surface layer was used. As the heater 4 and the recording material 4, the same items as in Example (1) were used. The setting temperature at the moment of initial printing was 190° C. Control was performed with 195° C. from the 20th to 39th sheets, and with 200° C. after the 40th sheets. As a result, the temperature at the central portion of the fixing roller was maintained at about 190° C., fixing property was excellent, and no offset occurred.

As described above, even if the configuration of the fixing roller is changed, temperature control may be performed in accordance with the change. Hence, the present invention may of course be applied to various kinds of rollers.

Next, a fourth embodiment will be explained.

In the third embodiment, a waiting state is provided immediately after the end of printing, and the number of sheets of the recording material 4 stored in the memory 10 is reset. In this method, however, if printing is resumed immediately after the end of printing, the first target temperature of the fixing roller is set to To °C. for initial printing, and the heater 2 is turned off until the temperature at the position where the temperature detector 5 is disposed decreases down to To °C. Hence, the temperature at the central portion of the fixing roller 1 decreases down to To °C. or less, and failure in fixing occurs. In the present embodiment, the number of sheets of the recording material stored in the memory 10 is preserved for a predetermined time. When printing is resumed within that time, temperature control is started from the target temperature corresponding to the number stored in the memory 10, and the number of sheets of the recording material is subjected to accumulated addition (accumulated counting) relative to the contents preserved in the memory 10. Thus, it is possible to prevent the occurrence of failure in fixing even if printing is resumed immediately after the end of printing.

Figure 9:
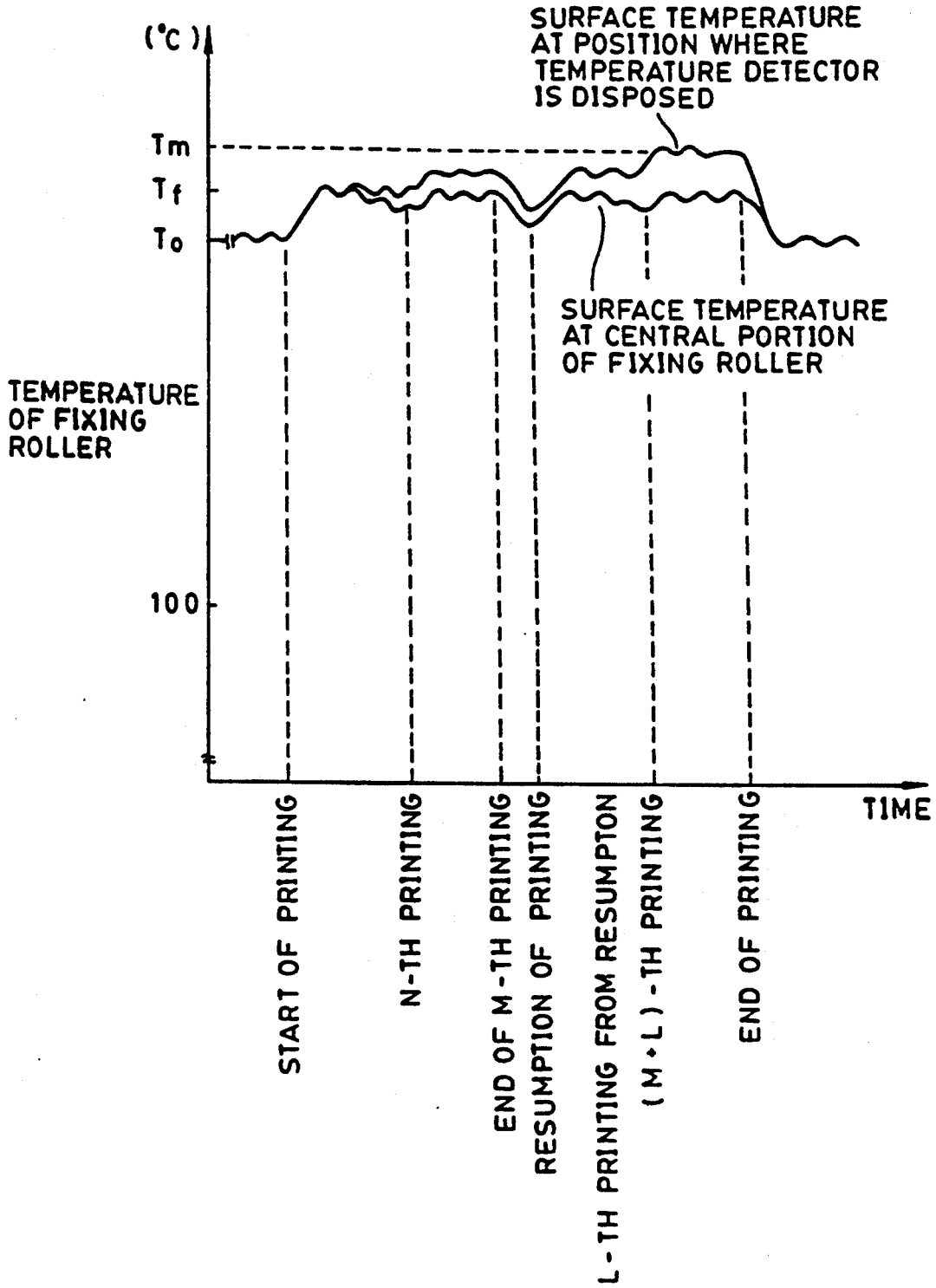
FIG. 9 is a diagram showing changes in the setting temperature of the surface of a fixing roller when image formation is resumed after continuous feeding of sheets of a recording material has once been terminated.

The configuration of the apparatus of the present embodiment is identical to that in the third embodiment, and a timer 11 is connected to the controller 8, as shown in FIG. 7. When the controller 8 receives a signal indicating the end of printing from the main control unit 9, the target temperature of the fixing roller 1 is set to that for a waiting state, and the timer 11 is started. When the value of the timer 11 reaches a predetermined time, the contents of the number of sheets of the recording material stored in the memory 10 are reset. The predetermined time is set to a larger value in accordance with larger sizes of recording material and the predetermined time is set to a smaller value in accordance with smaller sizes of recording material. When printing is resumed within the predetermined time, since the number of sheets of the recording material at the moment of the end of printing is stored within the memory 10, the target temperature corresponding to the number is set, and printing is started. Hence, the temperature of the central portion of the fixing roller 1 does not temporarily decrease, and failure in fixing therefore does not occur. FIG. 9 shows changes in the temperature of the fixing roller 1 when the above-described control is performed.

In FIG. 9, there is shown a state in which printing is resumed within a predetermined time after printing ended at the M-th sheet. The fixing roller 1 is heated to a target temperature Tm °C. corresponding to the (M+L)-th sheet immediately after printing has been resumed. The predetermined time is determined from the speed of temperature decrease when the fixing device is subjected to natural cooling, and is set within the time required for the temperature to decrease from the target temperature for the M-th sheet to the target temperature at the moment of waiting.

Next, an experimental example according to the fourth embodiment will be explained.

The configuration of the apparatus in the present experimental example is identical to that used in Example (2) in the third embodiment. The timer 11 was started simultaneously with the end of printing, and the number of sheets of the recording material stored in the memory 10 was reset after 30 seconds. No failure in fixing occurred even immediately after printing was resumed.

As an improved method of the present embodiment, a method in which the stored contents are subtracted from the number of sheets of the recording material stored in the memory 10 in accordance with the speed of temperature decrease in the fixing roller 1 after the end of printing is also effective. In this method, it is possible to set the temperature at the central portion of the fixing roller 1 to the temperature Tf °C. for printing more quickly when printing is resumed.

Next, the fifth embodiment of the present invention will be explained.

Figure 10:
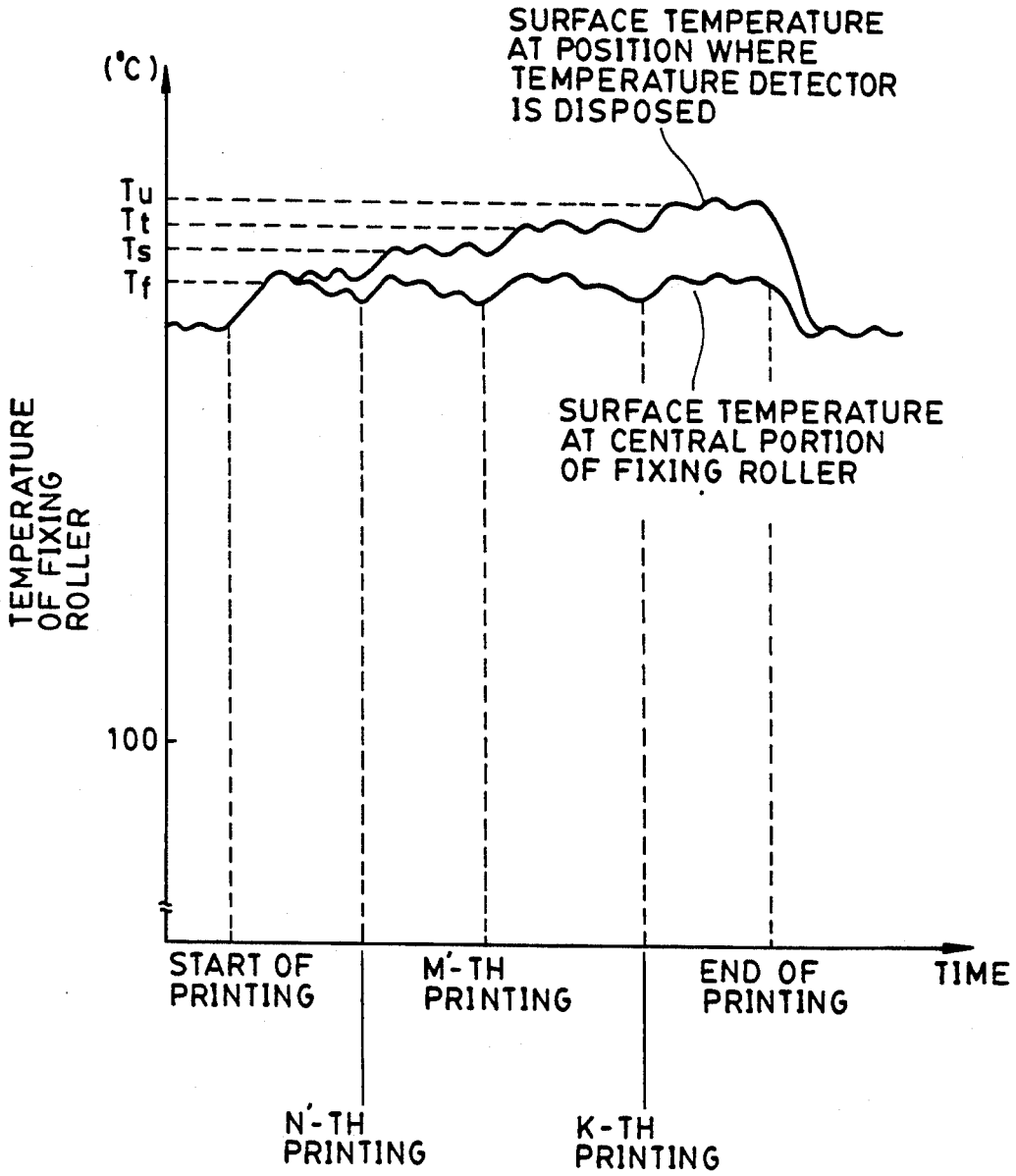
FIG. 10 is a diagram showing changes in the setting temperature of the surface of a fixing roller when the size of a recording material is smaller than in other embodiments of continuous feeding.
Figure 12:
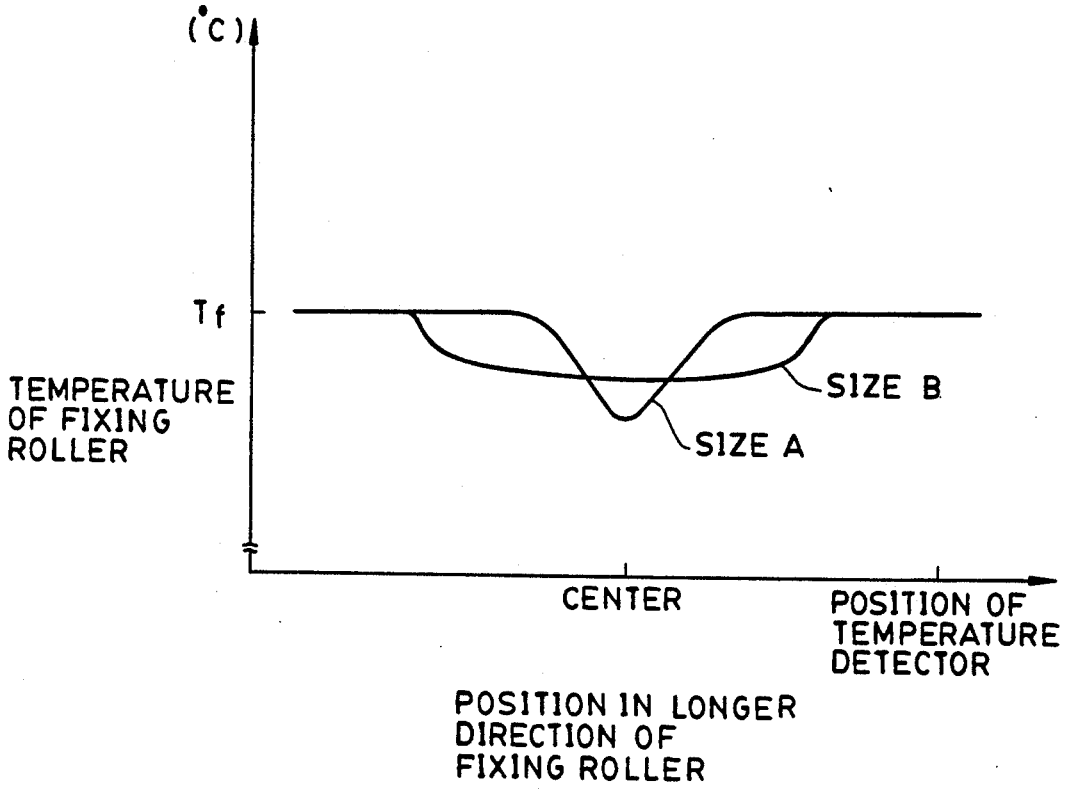
FIG. 12 is a diagram showing the distribution of the surface temperature of a fixing roller when the sizes of recording materials are different from each other.

In the present embodiment, the width of a recording material is taken into consideration. FIG. 12 shows the temperature distribution in the longitudinal (axial) direction of the fixing roller 1 when 30 sheets of each of two kinds of recording materials having different widths are fed through. Since the width of a size-A recording material is smaller than the width of a size-B recording material, the temperature difference between a central portion and an end portion of the fixing roller 1 becomes different even if printing is performed for the same number of sheets of the recording material. Furthermore, the temperature difference between the central portion of the fixing roller 1 and the position where the temperature detector 5 is disposed which is finally produced is larger for a recording material having a smaller lateral width. The present embodiment solves these problems. FIG. 10 shows changes in the surface temperature of the fixing roller 1 when a small-sized recording material is fed through according to the present embodiment. In the present embodiment, the target temperature is switched at a number of sheets of the recording material smaller than in the case of the third embodiment shown in FIG. 8. Switching from Tf ° C. to Ts ° C. is performed at the N'(<N)-th sheet, and switching from Ts ° C. to Tt ° C. is performed at the M'(<M)-th sheet. The setting temperature is further set to Tu ° C. at the K-th sheet.

It is possible to change the target temperature and the number of sheets of the recording material as the basis for switching the target temperature in accordance with the kind of the recording material to be used. When the size of a recording material is detected by mounting a cassette (not illustrated) for supplying the recording material on the image forming apparatus, the detection may be performed by a known method.

An experimental example according to the fifth embodiment will now be explained.

The apparatus used in the present experimental example was identical to that used in Example (2) of the third embodiment except that means 12 for detecting the width of a recording material is connected to the controller 8. Sheets of a recording material having the B5 size and a weight of 75 g were used. In this case, the setting temperature was switched to 195° C. after the 15th sheet from the start of printing, to 200° C. after the 30th sheet, and to 205° C. after the 45th sheet. As a result, the temperature at the central portion of the roller could be maintained at 190° C., and no failure in fixing occurred. Furthermore, when sheets of a recording material having the A4 size and a weight of 75 g were used, since the method of the third embodiment was used as it was, fixing property was excellent also in the case of the A4 size.

Next, the sixth embodiment of the present invention will be explained.

In the third through fifth embodiments described above, an explanation has been provided of a case in which sheets of a recording material are fed at an equal time interval. Actually, however, an interval for the entrance of a sheet of a recording material into the fixing roller 1 is random, because printing is performed by a signal from the main control unit 9. In the third through fifth embodiments, while signals continue to be output from the main control unit 9 so as to maintain a printing state, the image forming apparatus determines that continuous recording is being performed and sets the temperature to the temperature for printing. Accordingly, if an interval for feeding a sheet of a recording material is long, the temperature is gradually increased despite the fact that the temperature difference in the longitudinal (axial) direction of the fixing roller 1 is decreased due to heat conduction. This causes the temperature at the central portion of the fixing roller 1 to become too high. Hence, offset sometimes occurs. The present embodiment solves such a problem.

Figure 11:
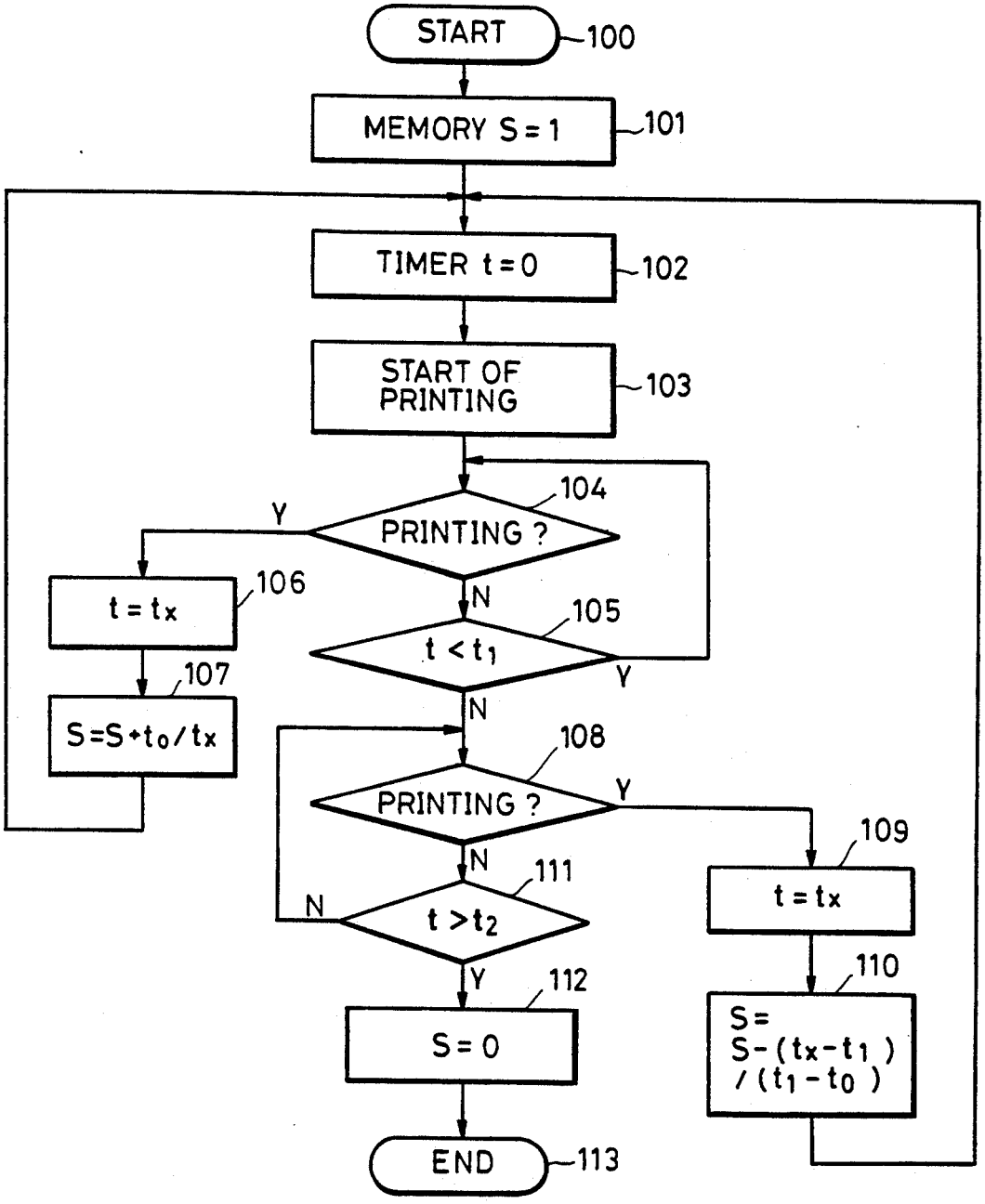
FIG. 11 is a flowchart showing a method of temperature control for a fixing roller when sheets of a recording material are continuously fed with random intervals.

The method of temperature control according to the present embodiment will be explained with reference to the flowchart shown in FIG. 11.

First, when a printing signal enters, temperature control is started (100). After a memory S is reset to 1 (101), a timer t is set to 0 (102), and printing operation is performed (103). After the end of printing, it is determined whether or not the next signal for the start of printing exists (104). If not, it is determined whether or not the value of the timer t is smaller than $t_1$. In the case of a smaller value, a waiting state for a signal for the start of printing is provided (105-104). The time $t_1$ is a time required for a decrease in temperature produced in the fixing roller 1 due to a printing operation to return to its original state, and is a constant. If a signal for printing enters, the timer t is stopped (106), and the value $t_0/t_x$ obtained by dividing $t_0$ by the value $t_x$ of the timer at that moment is added to the memory S (107). The time $t_0$ is a time required for one printing operation when printing is continuously performed at the maximum speed, and is obtained by dividing the length of the printing material plus the interval for the recording material by the conveying speed. The value $t_0$ is a constant. For example, $S+t_0/t_x>S+1$, when $t_x<t_0$. This indicates that the next printing operation must be performed at the fixing temperature when the memory $S=S+1$, and that the temperature does not return to the state when $S=S$ (that is, the state before the start of printing). Subsequently, the next printing operation is performed.

When the value of the timer t is $t_1$ or more and there is a signal for printing (108), the value $(t_x-t_1)/(t_1-t_0)$ is subtracted from the memory S, where $t_x$ is the value of the timer t when there is a signal (109→110). At this time, $t_x \geqq t_1$, and $S-(t_x-t_1)/(t_1-t_0) \leqq S$. This indicates that the next printing operation must be performed at the fixing temperature when the memory $S=S$ or less. That is, an interval between adjacent sheets of the recording material is proportionately larger.

If there is no signal for printing even when the value of the timer t becomes $t_1$ or more, it is checked whether or not the value of the timer t is $t_2$ or less. If the result is affirmative, a state of waiting for a signal for printing is provided again. When the value of the timer t is larger than $t_2$, it is determined that continuous printing is not performed. In this case, the memory S is reset (112), and temperature control is stopped (113).

Thus, the target temperature corresponding to the number of sheets of the recording material is set in consideration of heat conduction even if the interval between adjacent sheets of the recording material changes. Hence, the temperature of the fixing roller does not increase too much, and the occurrence of offset is prevented.

An experimental example according to the sixth embodiment will now be explained.

The configuration of the apparatus used in the present experimental example was identical to that used in Example (2) of the third embodiment. In the third embodiment, sheets of a recording material having a letter size were printed at a speed of 16 sheets per minute, and the interval for feeding sheets of the recording material was constant. When the interval for feeding the recording material was made random and printing was performed at a speed of 8 sheets per minute, the temperature at the central portion of the fixing roller achieved 198° C. at the 40th sheet in the third through fifth embodiments, and offset occurred. In the present embodiment, however, when control was performed with $t_0=3.75$ sec., (60 sec./16 sheets per minute) $t_1=6.00$ sec. and $t_2=30$ sec., the temperature at the center of the fixing roller 1 neither exceeded 195° C. nor decreased down to 185° C. or less, and neither failure in fixing nor offset occurred.

Although six embodiments in the present invention have been described above, information from the recording material is not limited to size and number of sheets of the recording material, but the overall characteristics (the kind of material, thickness and the like of the recording material) of the recording material may, for example, be considered. Furthermore, although, in the present embodiments, a case in which the temperature detection means contacts the fixing roller has been described, the same approach may also be used even in the case of noncontacting detectors.

As explained above, according to the present invention, temperature detection means is provided corresponding to substantially outside a passing region of a recording material, and temperature control is performed in accordance with information from the recording material so that the surface temperature at a central portion of a rotating body as fixing means becomes a predetermined temperature. Hence, it is possible always to obtain a stable fixing temperature, and, as a result, neither failure in fixing nor offset occurs.

What is claimed is:

1. An image forming apparatus comprising:

means for forming an unfixed toner image on a recording material;

fixing means including a pair of rotating members at least one of which is heated by a heating source, for fixing the unfixed toner image on the recording material by conveying the recording material past a passing region of the pair of rotating members;

temperature detection means for detecting a surface temperature of at least one of said rotating members, said temperature detection means being provided in a region outside the passing region of a toner image of the largest-sized recording material used in said image forming apparatus;

size detection means for detecting a size of the recording material; and control means for controlling said heating source so as to adjust the surface temperature detected by said temperature detection means to a predetermined temperature, said control means changing said predetermined temperature in accordance with the recording material width size detected by said size detection means so that progressively smaller width sizes of recording material correspond to progressively higher predetermined temperatures.

2. An image forming apparatus according to claim 1, wherein said temperature detection means detects the surface temperature of the heated rotating member.

3. An image forming apparatus according to claim 1 or 2, wherein said temperature detection means contacts a surface of said at least one of said rotating members.

4. An image forming apparatus according to claim 1, wherein a part of said temperature detection means is provided in a region on said at least one of said rotating members that corresponds to the size of recording material having the largest size used in said image forming apparatus and outside a toner image region on said recording material having the largest size.

5. An image forming apparatus according to claim 1, wherein said predetermined temperature is set so that a surface temperature at a central portion of said at least one of said rotating members is a temperature which is necessary for fixing the toner image.

6. An image forming apparatus according to claim 1, wherein said size detection means detects a width of the recording material which corresponds to the longitudinal direction of said rotating member.

7. An image forming apparatus comprising:

image forming means for forming an unfixed image on a recording material;

a pair of fixing rotating members forming a nip, at least one of said pair of fixing rotating members being heated by a heating source, said pair of fixing rotating members fixing an unfixed image onto a first recording material and a second recording material which are fed through said nip, said second recording material having a width different from said first recording material;

a temperature detecting element for detecting a surface temperature of at least one of said pair of fixing rotating members, wherein said temperature detecting element is positioned outside both the passing region of said first and second recording materials and is spaced farther away from a side edge of said second recording material than from a side edge of said first recording material;

control means for controlling electricity to said heating source so as to maintain the surface temperature detected by said temperature detecting means at a predetermined temperature;

wherein said predetermined temperature for said second recording material is higher than the predetermined temperature for said first recording material.

8. An image forming apparatus according to claim 7, wherein said recording materials are fed at a reference point of the center line of the recording material, the width of said second recording material being smaller than the width of said first recording material.

9. An image forming apparatus according to claim 8, wherein said temperature detecting element is in contact with a surface of at least one of said pair of fixing rotating members.

10. An image forming apparatus according to claim 7, wherein said first recording material has the maximum width usable in the apparatus.

11. An image forming apparatus according to claim 7, further comprising size detecting means for detecting sizes of recording materials, said control means determining a fixing temperature in accordance with the detection results obtained by said size detecting means.

12. An image forming apparatus according to claim 7, wherein said image forming apparatus is capable of continuously feeding recording-material sheets.

13. An image forming apparatus comprising:

image forming means for forming an unfixed image on a recording material;

a pair of fixing rotating members forming a nip, at least one of said pair of fixing rotating members being heated by a heating source, a first recording material having a first size and a second recording material having a second size being feedable through said nip to allow an unfixed image to be fixed thereon;

a temperature detecting element for detecting a surface temperature of at least one of said pair of fixing rotating members, wherein said temperature detecting element is provided at a position within the passing region of said first recording material and outside the passing region of said second recording material;

control means for controlling electricity to said heating source so as to maintain the surface temperature detected by said temperature detecting element at a predetermined temperature;

wherein said predetermined temperature for said second recording material is higher than the predetermined temperature for said first recording material.

14. An image forming apparatus according to claim 13, wherein said temperature detecting element is provided outside the image region of said first recording material.

15. An image forming apparatus according to claim 13, wherein said temperature detecting element is in contact with a surface of at least one of said pair of fixing rotating members.

16. An image forming apparatus according to claim 13, wherein said first recording material has the maximum width usable in the apparatus.

17. An image forming apparatus according to claim 13, further comprising size detecting means for detecting the sizes of recording materials, said control means determining a fixing temperature in accordance with the detecting results obtained by said size detecting means.

18. An image forming apparatus according to claim 13, wherein said image forming apparatus is capable of continuously feeding recording-material sheets.

19. An image forming apparatus comprising:

image forming means for forming an unfixed image on a recording material;

a pair of fixing rotating members for fixing the unfixed image onto a recording material carried through a nip formed by said pair of fixing rotating members, wherein at least one of said pair of fixing rotating members is heated by a heating source;

a temperature detecting element for detecting a surface temperature of at least one of said pair of fixing rotating members, said temperature detecting element being provided outside a passing region of a recording material having the largest width;

control means for controlling electricity to said heating source so as to maintain the surface temperature detected by said temperature detecting element at a predetermined temperature;

counting means for counting each completed fixing operation; and accumulating means for accumulating the total number of counted completed fixing operations;

wherein said control means raises said predetermined temperature when the accumulated total number of said accumulating means reaches a predetermined value; and wherein, when the recording material is continuously fed through the nip of said pair of fixing rotating members, a difference between a temperature of a surface region of the fixing rotating member detected by the temperature detecting element and a temperature of the passing region of the recording material increases.

20. An image forming apparatus according to claim 19, further comprising a resetting means for resetting the value counted by said counting means.

21. An image forming apparatus according to claim 20, wherein said resetting means resets the counted value when the next fixing operation is not conducted within a predetermined time after the termination of a fixing operation.

22. An image forming apparatus according to claim 19, wherein said apparatus feeds recording materials having different sizes to said fixing rotating member.

23. An image forming apparatus according to claim 19, wherein said temperature detecting element is in contact with a surface of at least one of said pair of fixing rotating members.

24. An image forming apparatus according to claim 19, wherein said image forming apparatus is capable of continuously feeding recording-material sheets.

* * * * *

UNITED STATES PATENT AND TRADEMARK OFFICE

CERTIFICATE OF CORRECTION

PATENT NO. : 5,331,384

DATED : July 19, 1994

INVENTOR(S) : Otsuka, et al.

It is certified that error appears in the above-identified patent and that said Letters Patent is hereby corrected as shown below:

COLUMN 1

Line 27, "(Chalk)" should read --(Kokai)--.

COLUMN 6

Line 67, "heater 4" should read --heater 2--.

COLUMN 9

Line 43, "(105-104)." should read --(105→ 104).--.

COLUMN 10

Line 33, "3.75 sec.," should read --3.75 sec.--;
Line 33, "minute)" should read --minute),--; and
Line 40, "size" should read --the size--.

Signed and Sealed this

Tenth Day of January, 1995

*Attest:*

*Attesting Officer*

BRUCE LEHMAN

*Commissioner of Patents and Trademarks*